US005598593A

United States Patent [19]

Wolfe

[11] Patent Number: 5,598,593

[45] Date of Patent: Feb. 4, 1997

[54] INFLATABLE AIR BED

[75] Inventor: Henry Wolfe, Palmetto, Fla.

[73] Assignee: Aqua-Leisure Industries, Inc., Avon, Mass.

[21] Appl. No.: 387,023

[22] Filed: Feb. 10, 1995

[51] Int. Cl.[6] ..... A47C 27/10

[52] U.S. Cl. ..... 5/710; 5/711; 5/712

[58] Field of Search ..... 5/455, 457, 458, 5/710, 711, 712

[56] References Cited

U.S. PATENT DOCUMENTS

| | | | |
|---|---|---|---|
| 800,967 | 10/1904 | Young et al. | 5/449 |
| 1,324,009 | 12/1919 | Hope | 5/413 |
| 2,604,641 | 7/1952 | Reid | 5/455 |
| 3,283,343 | 11/1966 | Worcester | 5/644 |
| 3,316,567 | 3/1965 | Yagi | 5/348 |
| 3,533,095 | 1/1969 | Collins | 340/272 |
| 3,705,429 | 12/1972 | Nail | 5/455 |
| 4,067,075 | 1/1978 | Leathers et al. | 5/82 |
| 4,149,541 | 4/1979 | Gammons et al. | 128/400 |
| 4,371,999 | 2/1983 | Reid | 5/457 |
| 4,391,009 | 7/1983 | Schild et al. | 5/453 |
| 4,428,087 | 1/1984 | Horn | 5/449 |
| 4,528,704 | 7/1985 | Wegener et al. | 5/81.1 |
| 4,594,743 | 6/1986 | Owen et al. | 5/111 |
| 4,629,433 | 12/1986 | Magid | 441/40 |
| 4,631,767 | 12/1986 | Carr et al. | 5/449 |
| 4,644,597 | 2/1987 | Walker | 5/449 |
| 4,807,313 | 2/1989 | Ryder et al. | 5/62 |
| 4,896,389 | 1/1990 | Chamberland | 5/453 |
| 4,908,895 | 3/1990 | Walker | 255/453 |
| 4,914,771 | 4/1990 | Afeyan | 5/453 |
| 4,951,335 | 8/1990 | Eady | 5/450 |
| 4,999,867 | 3/1991 | Toivio et al. | 5/455 |
| 5,044,030 | 9/1991 | Balaton | 5/455 |
| 5,067,189 | 11/1991 | Weedling et al. | 5/81.1 |
| 5,168,589 | 12/1992 | Stroh et al. | 5/455 |
| 5,243,721 | 9/1993 | Teasdale | 5/453 |
| 5,249,318 | 10/1993 | Loadsman | 5/453 |
| 5,249,319 | 10/1993 | Higgs | 5/453 |
| 5,265,293 | 11/1993 | Spahn et al. | 5/449 |

*Primary Examiner*—Alexander Grosz
*Attorney, Agent, or Firm*—Wolf, Greenfield & Sacks, P.C.

[57] ABSTRACT

An inflatable air bed. The air bed includes an inflatable lower chamber and an inflatable upper chamber overlying and attached to the lower chamber. Each chamber includes at least one valve for inflating and deflating the chamber. The lower chamber provides support for the upper chamber, which can be independently adjusted for user comfort.

20 Claims, 11 Drawing Sheets

INFLATABLE AIR BED

BACKGROUND OF THE INVENTION

1. Field of the Invention

The present invention relates to an air bed and, more particularly, to an inflatable air bed having separate, inflatable support and mattress chambers.

2. Description of the Related Art

Conventional inflatable air mattresses are available in a wide variety of sizes and configurations. Air mattresses are used in the health care industry, for example, as a patient mover or stretcher, or as a therapeutic mattress. More commonly, inflatable air mattresses are used in residential and recreational applications as a convenient spare bed in the home, or at the beach or camp site. Frequently, inflatable air mattresses include temperature and/or pressure regulation systems, or other devices to provide the user with comfort and convenience.

For example, a basic single-layered air mattress is disclosed by Reid in U.S. Pat. No. 4,371,999; a single-layer air support bed having a tubular frame is disclosed by Owen et al., in U.S. Pat. No. 4,594,743; and a mattress assembly, wherein an inflatable lower portion is position beneath a pile overlay is disclosed by Eady, in U.S. Pat. No. 4,951,335. An air mattress with a pressure relief valve is disclosed by Walker, in U.S. Pat. No. 4,644,597.

Although providing a wide variety of air mattresses for many different applications, having a wide variety of features, none of the foregoing single-layer air mattress assemblies provides both comfort and support. Moreover, none of the foregoing, or similar devices, provide comfort and support in a simple device which can be easily inflated and deflated, and stored in a relatively small space. In addition, none of the foregoing, or similar devices, provide a multi-layer device, wherein each layer is independently adjustable.

It is, therefore, an object of the present invention to provide an improved inflatable air bed, providing users with additional comfort and support.

It is another object of the present invention to provide a multi-layer inflatable air bed, in which each layer can be independently adjusted.

It is a further object of the present invention to provide an inflatable air bed that is easily and quickly inflated and deflated, and able to be stored conveniently.

It is still another object of the present invention to provide retailers with multi-layer inflatable air beds which require reduced shelf space.

It is another object of the present invention to provide an inflatable air bed that is aesthetically pleasing, secure, and comfortable to use.

SUMMARY OF THE INVENTION

Accordingly, the present invention is directed to an inflatable air bed, including an inflatable lower chamber having at least one valve for inflating and deflating the entire lower chamber. The air bed further includes an inflatable upper chamber, which is overlying and attached to the lower chamber, having at least one valve for inflating and deflating the entire upper chamber. The upper chamber can be made soft by adjusting the inflation of the chamber, while the lower chamber is more rigid to support the upper chamber and maintain the proper dimensions and shape of the air bed.

In one embodiment, the air bed of the present invention is formed from three sheets of a soft, flexible, resilient material which are overlayed and joined at their edges to form an upper and lower chamber. The upper and lower chambers are divided into a plurality of longitudinal passages with a plurality of retention members, or beams. Each beam is joined to the top and bottom sheets of the chamber and functions to limit outward expansion of the top and bottom walls.

In another embodiment of the present invention, an inflatable air bed includes separate upper and lower inflatable chambers, wherein the upper chamber overlays and is attached to the lower chamber by a central gusset, which extends around and is heat welded to the outer periphery of both chambers.

In another embodiment of the present invention, the top layer of the inflatable upper chamber includes a flocking material to provide a soft, material-like finish to the inflatable air bed.

BRIEF DESCRIPTION OF THE DRAWINGS

The foregoing and other objects and advantages of the invention will be appreciated more fully from the following drawings in which.

DETAILED DESCRIPTION OF THE INVENTION

Figure 1A:
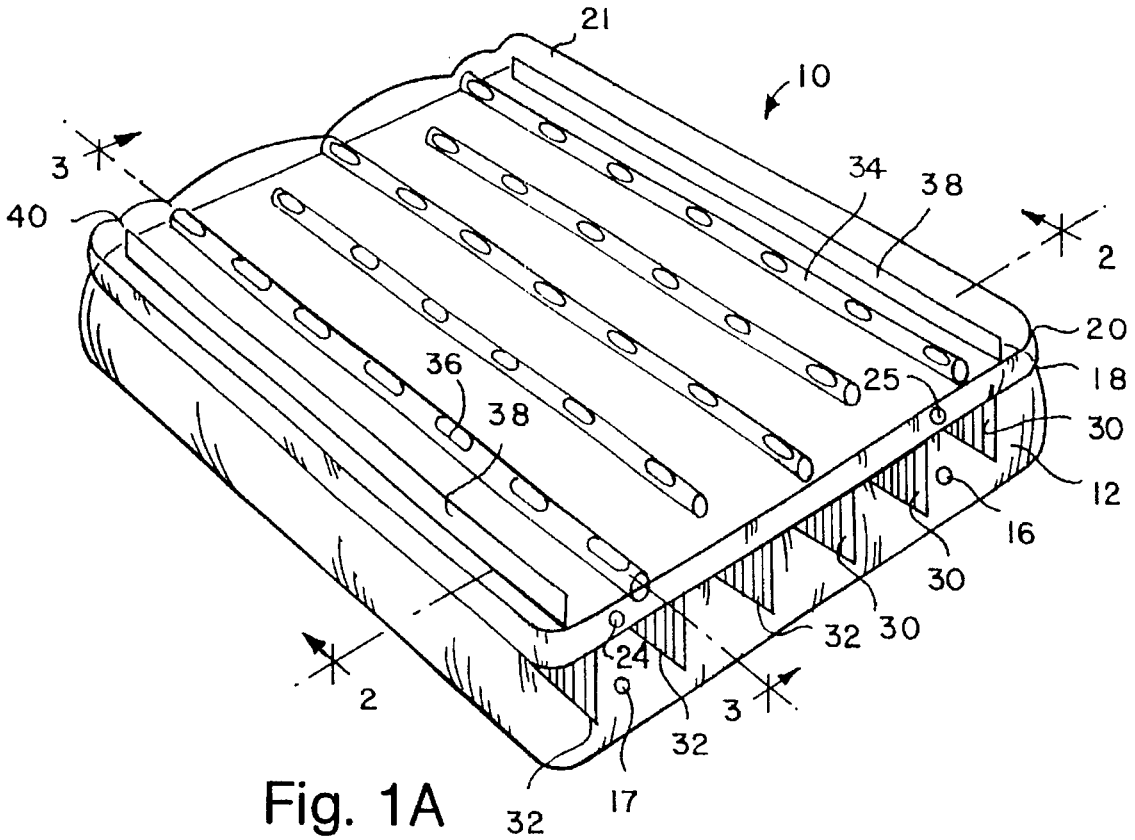
FIG. 1A is a perspective view of one embodiment of the inflatable air bed of the present invention.

The present invention is directed to an inflatable air bed, including an inflatable lower chamber, having at least one valve for inflating and deflating the entire lower chamber. The air bed further includes an inflatable upper chamber, overlying and attached to said lower chamber, having at least one valve for inflating and deflating the entire upper chamber.

Referring now to the drawings, in which like reference numerals indicate like elements, FIGS. 1A, 1B, 2, 3, and 4A represent one embodiment of an inflatable air bed 10 of the present invention.

Figure 2:
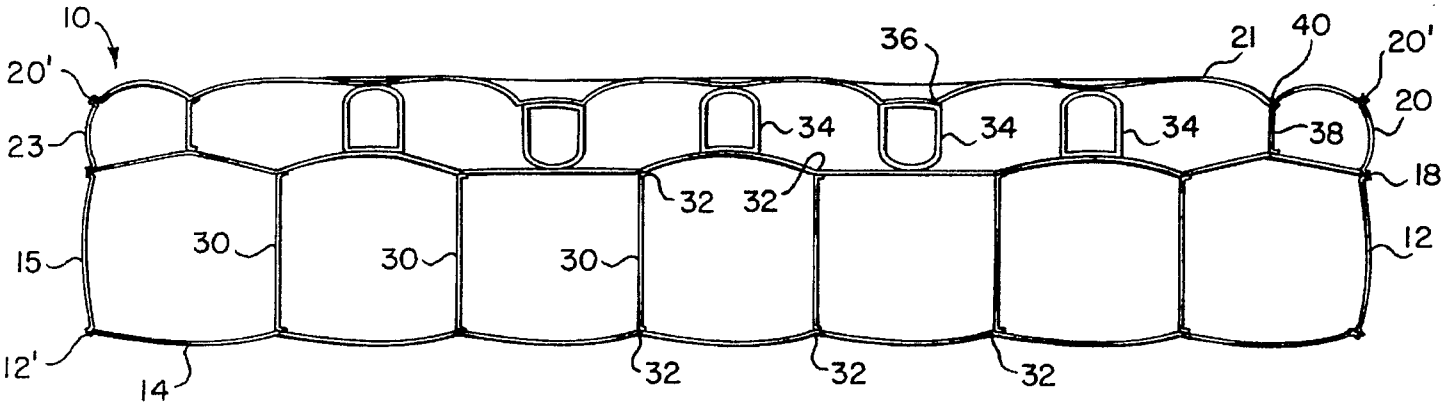
FIG. 2 is a cross-sectional side view of the inflatable air bed shown in FIG. 1A, taken along section line 2—2.
Figure 3:
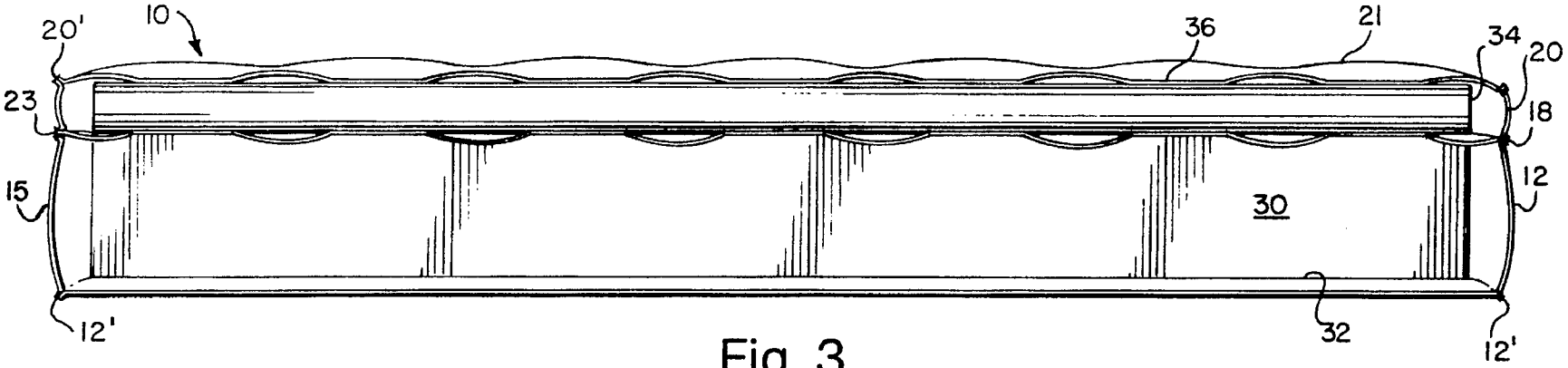
FIG. 3 is a cross-sectional side view of the inflatable air bed shown in FIG. 1A, taken along section line 3—3.
Figure 4A:
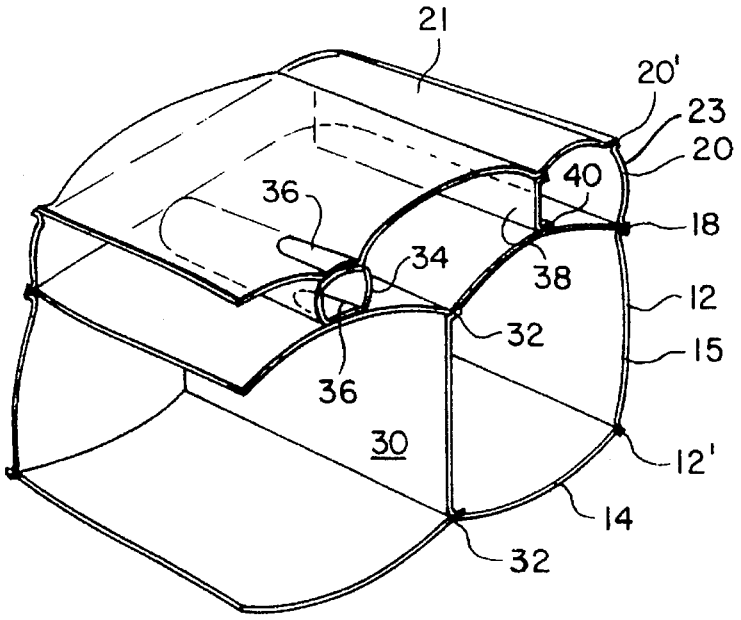
FIG. 4A is a cutaway perspective view of the inflatable air bed shown in FIG. 1A.

In these figures, an air bed 10 is shown including an inflatable lower chamber 12 having a bottom layer 14, and a side gusset panel 15, which extends around the outer edge of the bottom layer and is heat welded along the edge at 12'. Lower chamber 12 further includes a quick release valve 16 and a standard safety valve 17, which are secured directly to side gusset panel 15 of the lower chamber. Air bed 10 further includes an inflatable upper chamber 20, formed from a top layer 21, and a side gusset panel 23 which extends around the outer edge of the top layer and is heat welded along the edge at 20'. Upper chamber 20 further includes a quick release valve 24 and a standard safety valve 25 secured to the side gusset panel 23 of the chamber. As shown in FIGS. 2, 3, and 4A, the lower chamber 12 and the upper chamber 20 share a common wall, layer 18, that acts as the top layer of lower chamber 12 and the bottom layer of upper chamber 20. It is further noted that side gusset panels 15 and 23 can be provided as separate pieces of material, or as a larger, single side gusset (not shown) welded at 20', 18 and 12'. Once constructed and assembled through heat welding, adhesive bonding, stitching, and the like, the lower and upper chambers are independently inflatable and deflatable through either of their respective valves.

Figure 1B:
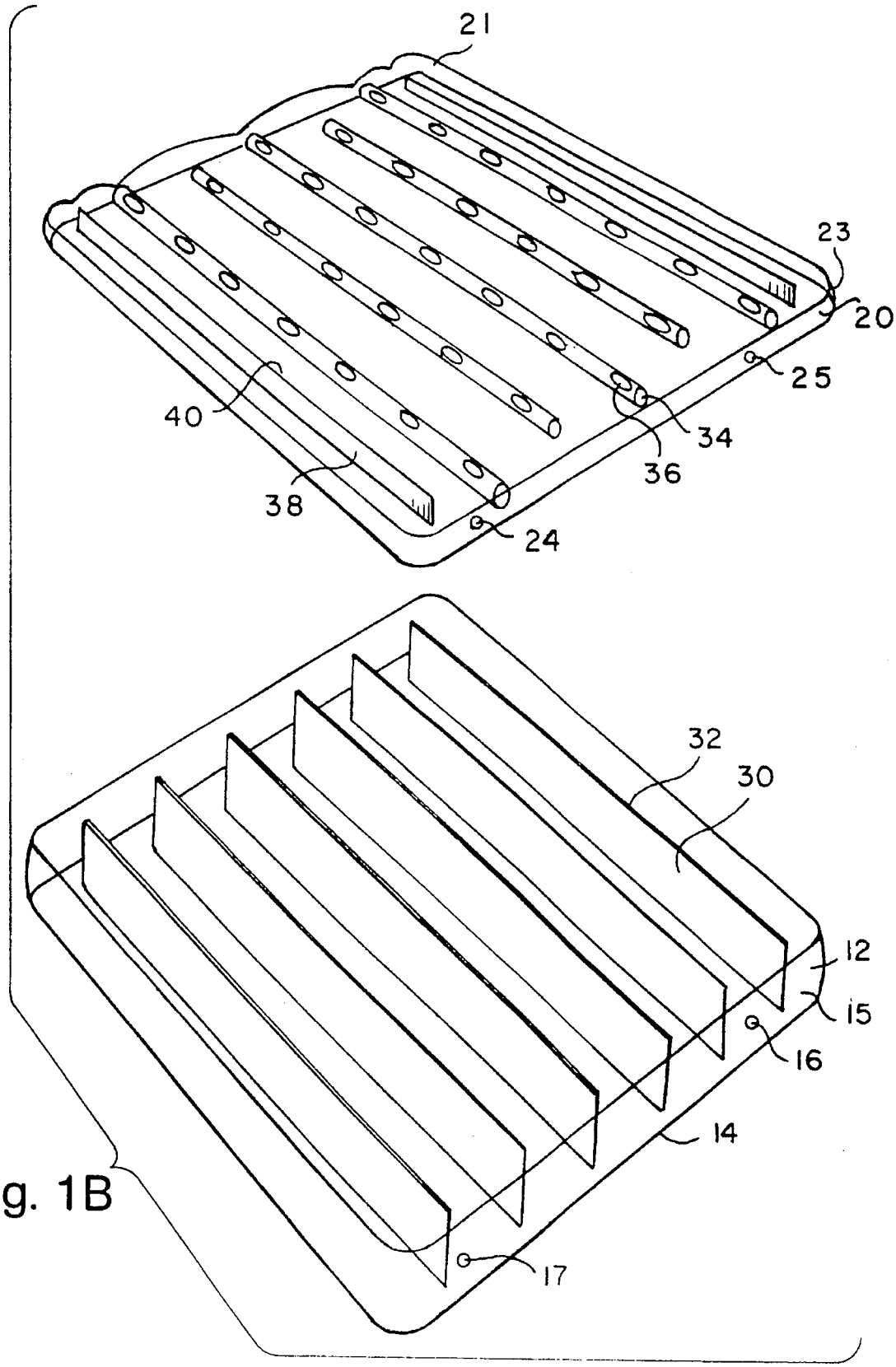
FIG. 1B is an exploded perspective view of the inflatable air bed shown in FIG. 1A.

As shown in FIG. 1B, lower chamber 12 includes a series of longitudinally disposed vertical walls, or I-beams 30, which are heat welded at 32 (also shown in FIG. 2) to the top and bottom layers of the chamber along their entire lengths. I-beams 30 act as retention members, and function to limit the outward expansion of the top and bottom layers of the lower chamber. This type of retention member is well known to those skilled in the art of inflation devices, such as floatation devices, air mattresses, and the like. Accordingly, although I-beam retention members are shown, other retention members can be used in the present invention, including tufted beam structures, coil-like beam structures, X-beam structures, and the like. It is noted that, whichever retention structures are used, the shape and comfort of the inflatable lower chamber 12 will be directly dependent upon the number of retention structures used therein.

Inflatable upper chamber 20, also shown in FIG. 1B, includes a series of longitudinally disposed tube-like retention structures, or O-beams 34. These retention structures are heat welded to the top and bottom layers of the chamber and also function to limit outward expansion, and therefore control the shape, of the chamber. In addition, the O-beam retention structures are more resilient and depress easier under the weight of a user than, heretofore, known retention structures and, therefore, provide a softer cushion. The O-beams 34 are heat welded to the top and bottom layers of the upper chamber in a series of spaced, elipse-like welds 36 along each longitudinal beam. It has been found that the elipse-like welds, and other curved or other discretely shaped welds, such as circular-, triangular-, or rectangular-shaped welds, provide users with more comfort than a rigid, narrow weld, such as a standard I-beam-type weld. As similarly noted in the lower chamber 12, however, alternative types of retention members can be used in the upper chamber 20, depending on the desired comfort, support, and cost of the air bed. Moreover, various types of retention members can be used in combination with each other. For example, as shown in FIG. 1B, I-beams 38 are placed on the outside of O-beams 34 to provide added support at the side portions of the upper chamber 20. The I-beams in the upper chamber are heat welded to the top and bottom layers at 40.

Figure 4B:
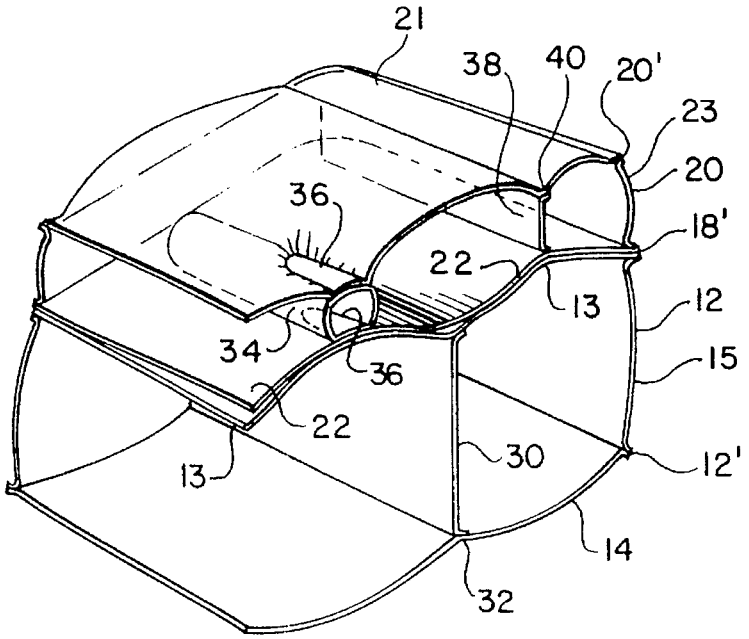
FIG. 4B is a cutaway perspective view of another embodiment of the inflatable air bed shown in FIG. 1A.

FIG. 4B is a cutaway perspective view of another embodiment of the present invention, wherein the lower chamber 12 has a separate top layer 13, and the upper chamber 20 has a separate bottom layer 22. These separate layers can be attached to each other by means known to those skilled in the art, such as welding, adhesive bonding, stitching, and the like, to form a common wall 18'.

Figure 5:
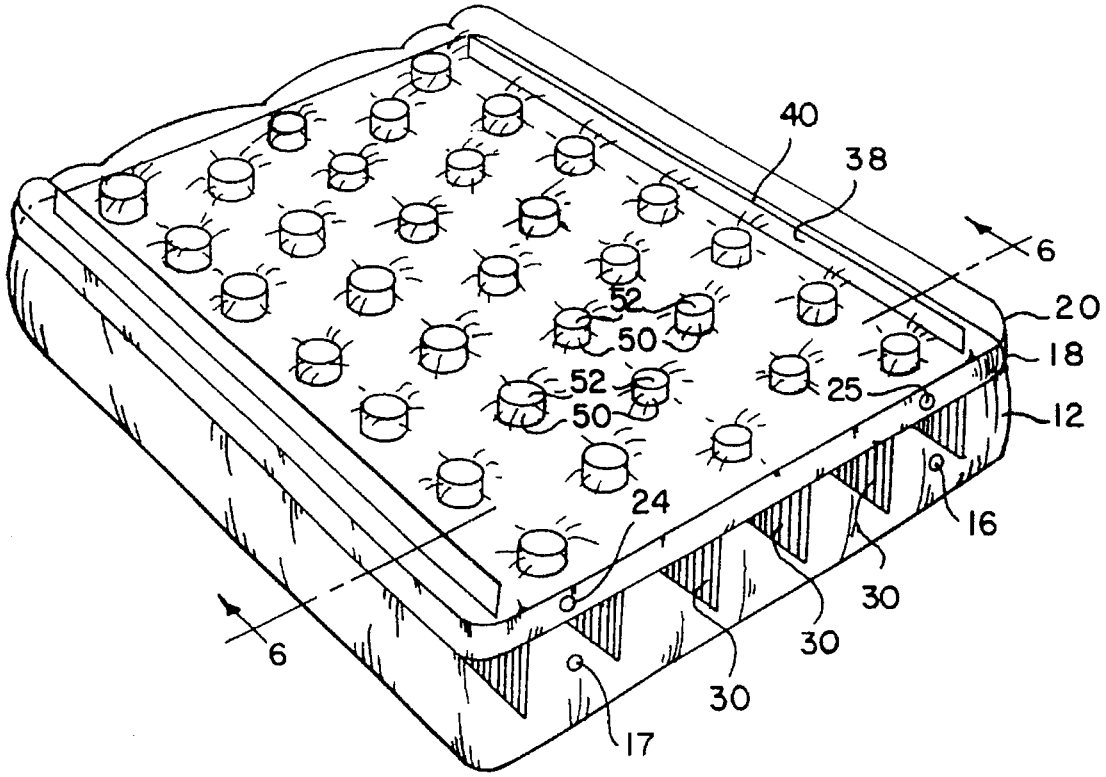
FIG. 5 is a perspective view of an alternative embodiment of the inflatable air bed of the present invention.
Figure 6:
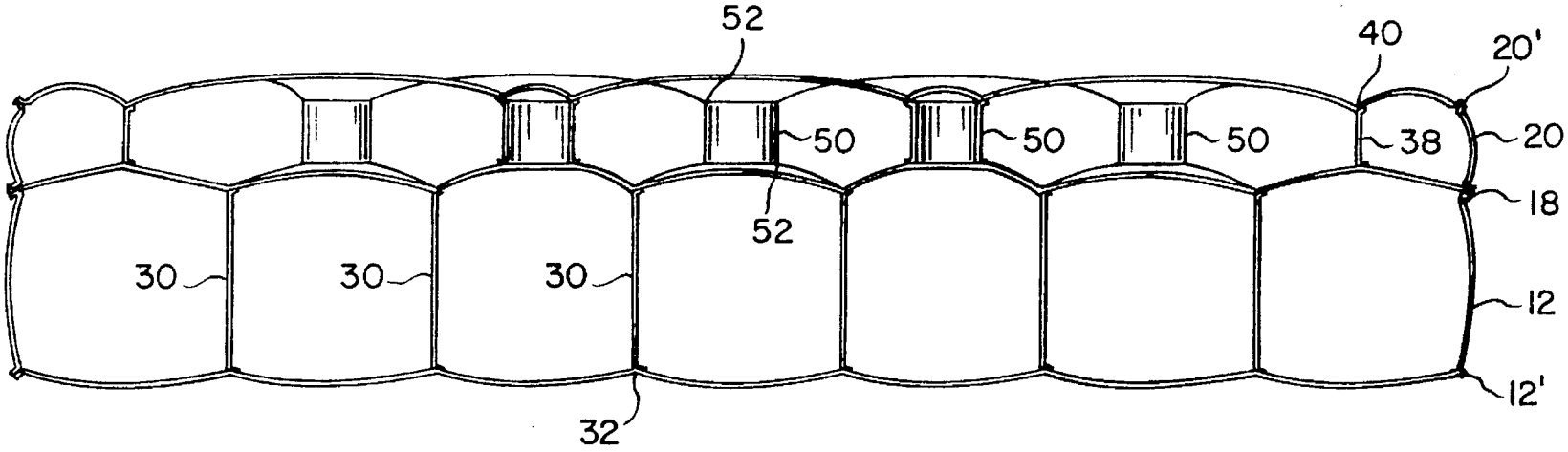
FIG. 6 is a cross sectional side view of the inflatable air bed shown in FIG. 5, taken along section line 6—6.
Figure 7A:
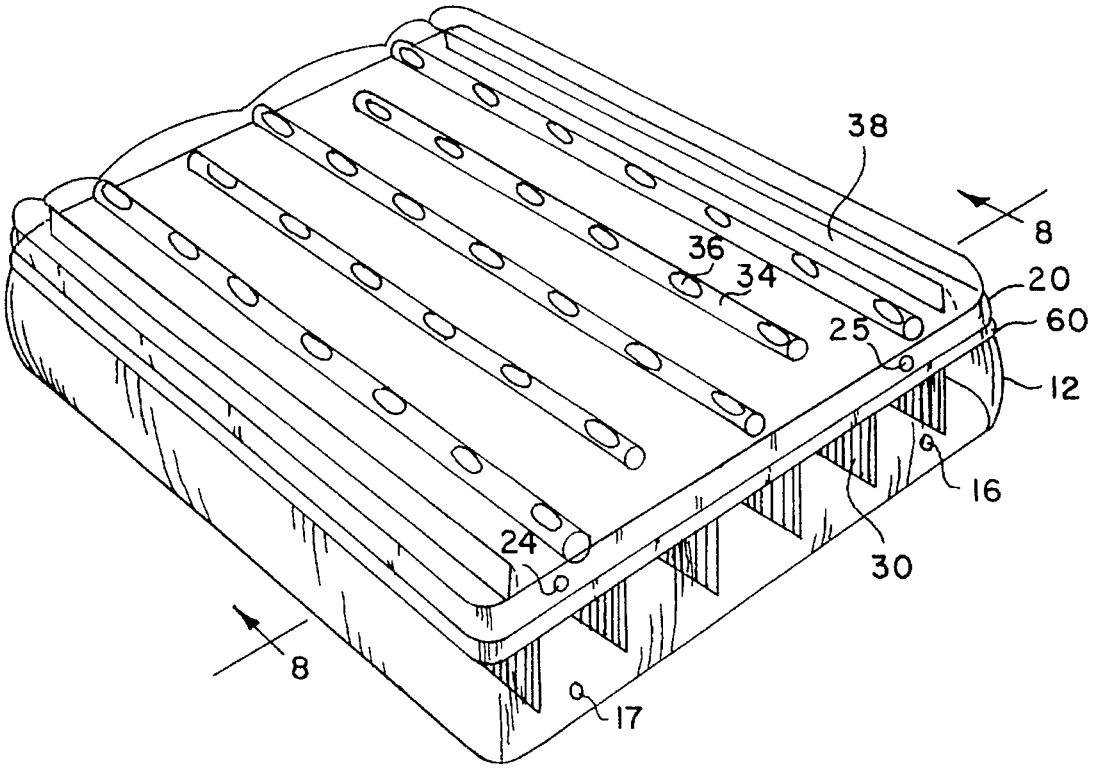
FIG. 7A is a perspective view of an alternative embodiment of the present invention.
Figure 7B:
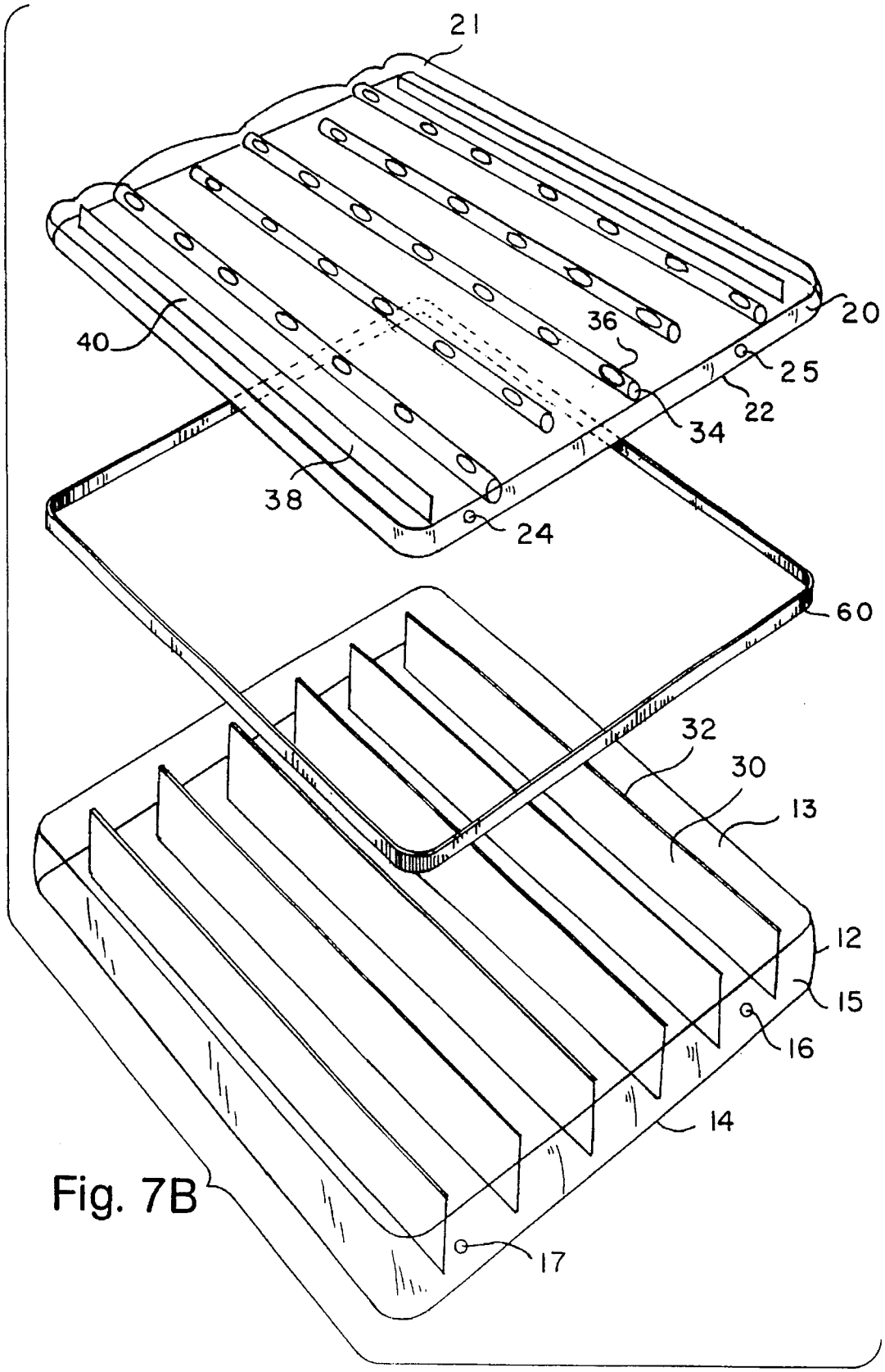
FIG. 7B is an exploded perspective view of the inflatable air bed shown in FIG. 7A.

FIG. 5 shows an alternative embodiment of the present invention, wherein coil-like beams 50 are used as support structures in upper chamber 20. As shown in FIG. 6, the coil beam structures are heat welded at 52 to the top and bottom layers of the upper chamber.

Figure 8:
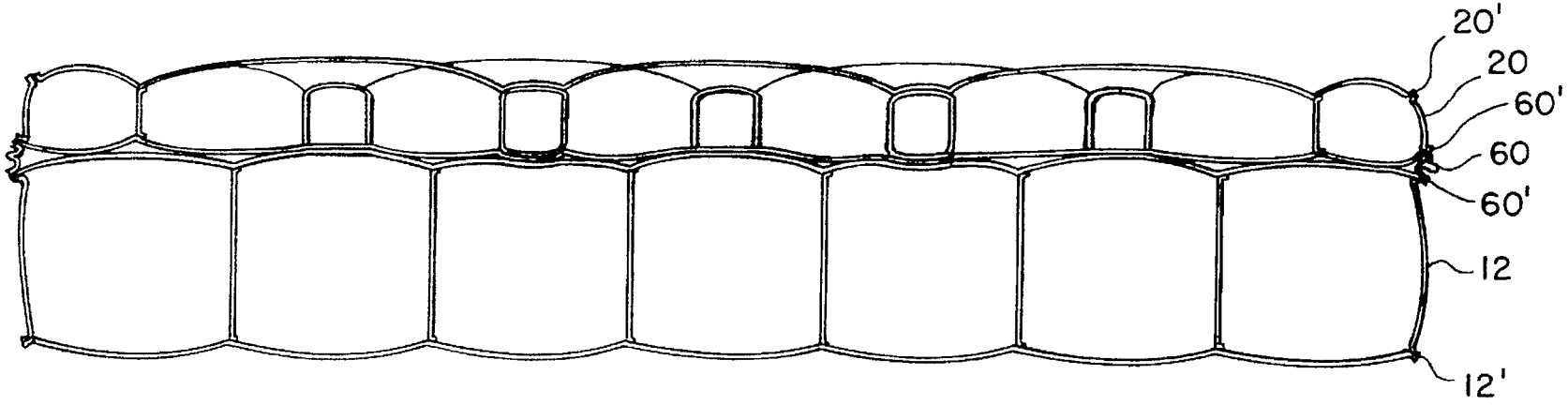
FIG. 8 is a cross-sectional side view of the inflatable air bed shown in FIG, 7A, taken along section line 8—8.
Figure 9:
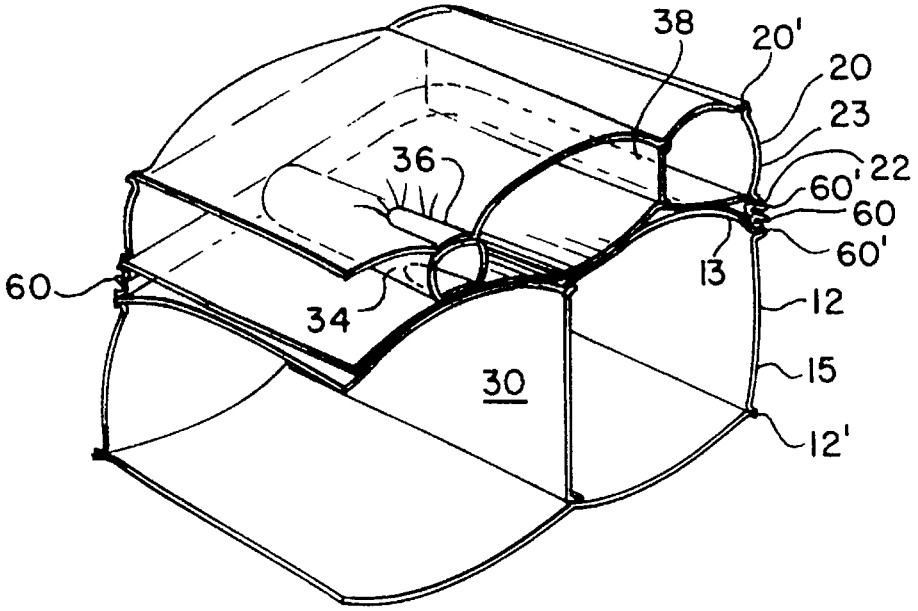
FIG. 9 is a cutaway perspective view of the inflatable air bed shown in FIG. 7A.
Figure 9A:
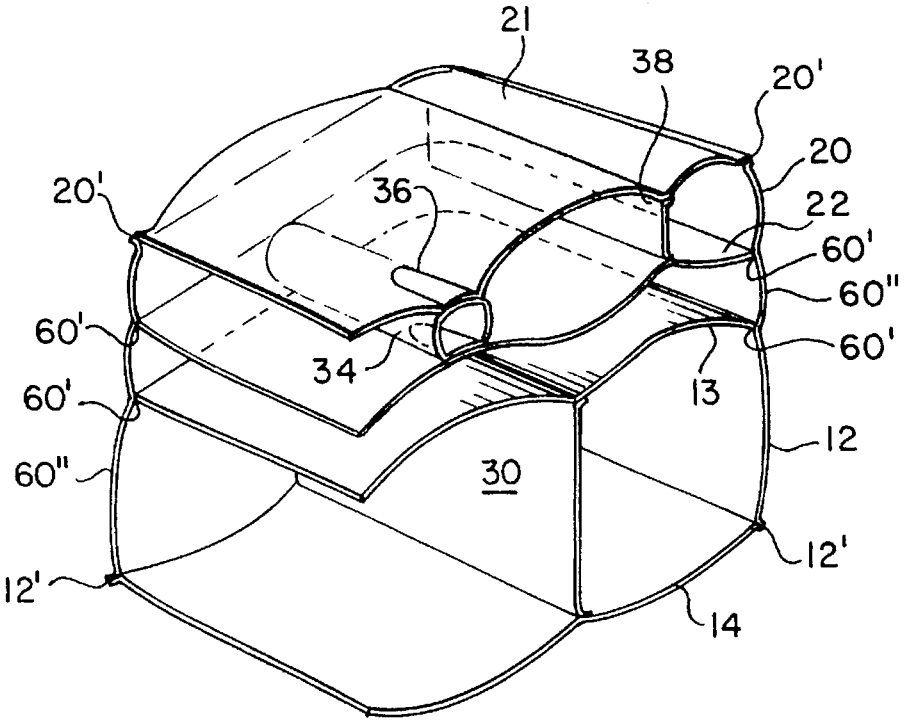
FIG. 9A is a cutaway perspective view of another embodiment of the inflatable air bed shown in FIG. 7A.

An alternative embodiment of the present invention is shown in FIGS. 7A, 7B, 8 and 9, wherein lower chamber 12, including top layer 13, is attached to upper chamber 20, including bottom layer 22, by a central gusset band 60, which is heat welded to the lower and upper chambers along the outer periphery, along side gusset panels 15 and 23, of each chamber at 60' (as shown in FIGS. 8 and 9). As noted above, the side gusset panels can also be provided as a single side gusset portion 60", as shown in FIG. 9A. This alternative embodiment also incorporates the gusset band as part of the single side gusset portion 60". As shown in FIG. 9A, lower chamber 12 and upper chamber 20 are formed and attached, as layers 21 and 22 (top and bottom layers of upper chamber 20) and layers 13 and 14 (top and bottom layers of lower chamber 12) are welded at 20', 60', and 12', respectively.

Figure 10:
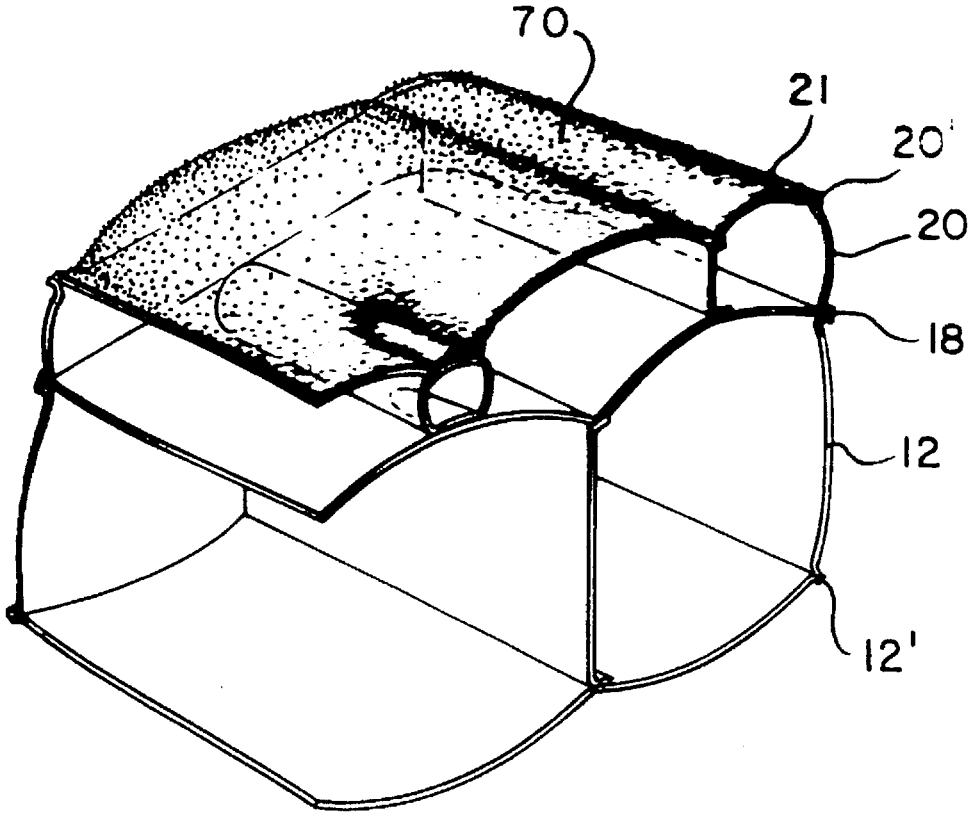
FIG. 10 is a cutaway perspective view of another embodiment of the inflatable air bed of the present invention with a fabric material covering.

Another embodiment of the present invention is shown in FIG. 10, wherein a flocking material 70 is applied to the top layer 21 of inflatable upper chamber 20. The flocking material is generally sprayed onto a surface to provide a velvet-like finish. Typically, the flocking material is made from a synthetic material such as nylon, rayon, polyester and the like. In addition, cotton flocking material and/or paper flocking materials can be used.

In all of the embodiments of the present invention, the upper and lower chambers are typically constructed of a soft, flexible, resilient material. The material should also be relatively inexpensive, while providing satisfactory sealing and mechanical properties. Typically, the lower and upper chambers 12, 20 of the air bed of the present invention are constructed of a vinyl plastic material, which addresses the above characteristics. Preferably, the chambers are constructed of polyvinyl chloride, due to its relatively inexpensive cost and availability, as well as its advantageous physical characteristics. It is noted, however, that other materials known to those of skill in the art, could be used to form one or both chambers. For example, polyethylene, polypropylene, nylon, latex, neoprene rubber, or a chlorosulfonated polyethylene, such as HYPALON™ synthetic rubber material (trademark of E.I. du Pont de Nemours, Wilmington, Del.), could be processed to provide the above-noted characteristics of the lower and upper inflatable chambers. Typically, plastics or rubber additives, such as stabilizers, antioxidants, softeners, and plasticizers, are added to the material used to form the lower and/or upper chambers to maintain or enhance softness and pliability, as well as to provide resistance to weathering, chemicals, and/or mildew. Moreover, additional additives may be added to provide strength and/or color to the material. These additives are all well known to those skilled in the art; plasticizers, for example, include polyols, such as ethylene glycol and its derivatives. After the desired additives are mixed into the chosen material (preferably polyvinyl chloride), the upper and lower chambers can be formed by processes known to those skilled in the art, such as calendaring, casting, extruding, and/or molding. The lower and upper chamber 12, 20 may be formed, for example, by heat welding the top, bottom and side gusset panels of each chamber, wherein the top and bottom layers are substantially rectangular shaped, and joining the two chambers together by their outer peripheries, preferably at an edge formed by welding the separate layers together.

Typically, the chosen material of construction of the lower and upper chambers has a thickness of between about 12 and about 28 gauge, and preferably between about 12 and about 20 gauge. It has been found that thicknesses within this range provide adequate strength while allowing each chamber to be easily inflated and cost effective to produce. Most preferably, each chamber 12, 20, including its individual components and support structures (I-beams, O-beams, etc.) has a thickness of at least about 16 gauge. It is noted, however, that when any chamber material layer includes a flocking material, the thickness is increased by at least about 8 gauge.

The quick release valves 16, 24 on the lower and upper chambers, respectively, have a wide opening for fast inflation and/or deflation. Typically, the chambers can be inflated through these valves with the use of standard household items, such as a hair dryer (on a cool setting), a vacuum cleaner on a reverse setting, a blower, a pump, and the like. The standard safety valves 17, 25 on the lower and upper chambers, respectively, can be any standard inflation valve, commercially available and known to those of skill in the art. Preferably, the valves 17, 25 are self-sealing, or one-way valves, which allow air flow into the chambers (but must be pinched to allow air flow out of the chambers). A forceful stream of air from a foot pump, hand pump, compressed air container and the like, can be introduced into the chambers through these valves. In operation, the safety valves are typically used to adjust the desired degree of inflation of the lower and upper chambers. All of the valves 16, 24 and 17, 25 used on the lower and upper chambers of air bed 10 are secured directly to the separate chambers. The valves can be secured to the chambers 12, 20, for example, with an adhesive, a heat weld, or other methods known to those skilled in the art. Although shown as circular objects secured to side gusset panels 15 and 23 in FIGS. 1A, 1B, 5, 7A, and 7B, these valves are known to those skilled in the art of inflatables, and are available in a wide variety of shapes and sizes. Moreover, it is noted that in the present invention, the quick release valves 16, 24 are preferably secured to a corner of top layer 21 of upper chamber 20, and a corner of bottom layer 14 of lower chamber 12 to avoid contact with users. The safety valves 17, 25 are preferably secured to side gusset panels 15 and 23 for easy access while adjusting the inflation of the chamber.

It is noted that while a standard air bed construction is in a substantially rectangular shape, available in standard twin-, double-, queen-, and king-sizes, other sizes and shapes, such as a circular air bed, can be provided by the present invention. The double separately inflatable chamber aspect of the present invention overcomes the disadvantages of traditional air mattresses by providing additional comfort and support. Traditionally, users adjusted the softness and comfort of a single-chamber air mattress by releasing air from the mattress until a comfort level was reached. This procedure, however, simultaneously reduced the mattresses support of the user, in that the weight load of the user became more centralized as the mattress air was released (resulting in the user "sinking" into the mattress), resulting in discomfort. The air bed of the present invention, regardless of its shape, allows a user to adjust the comfort level of the upper chamber while maintaining the integrity and support of the lower chamber. Therefore, the user's weight load is always supported and maintained by at least the fully inflated lower chamber.

The present invention will be further illustrated by the following example, which is intended to be illustrative in nature and is not to be construed as limiting the scope of the invention.

EXAMPLE

One suitable construction of an inflatable air bed having a shape and design substantially in accordance with the present invention is provided by the following combination of elements.

An inflatable air bed is provided, as shown in FIG. 1A and FIG. 10. The air bed includes an inflatable lower chamber constructed of 16 gauge thick polyvinyl chloride. The air bed further includes an inflatable upper chamber constructed of 16 gauge thick polyvinyl chloride, and includes a top layer outer surface having flocking material adhered thereto in a thickness of about 8 gauge. The flocking material is made of rayon and is applied over the polyvinyl chloride sheet prior to the construction of the upper chamber. The upper and lower chambers are similarly sized (to form a double size bed) 79 inches long, and 59 inches wide (deflated). The total air bed height is about 12 inches (inflated), the lower chamber being about 8 inches high and the upper chamber being about 4 inches high. Each chamber includes a quick release valve, which includes a polyvinyl chloride valve base heat sealed to the chamber, a rubber stopper, and a polypropylene cap. Each chamber also has a polyvinyl chloride safety valve heat welded to the chamber body.

The lower inflatable chamber includes six vertical walls, or I-beams, which run the length of the chamber. The I-beams are heat welded to the top and bottom portion of the lower chamber along their entire length. The I-beams are constructed of 16 gauge thickness polyvinyl chloride material. A space is provided at each end of the I-beams so that air (or other inflation gas) can work around the I-beams to fully inflate the chamber.

The upper inflatable chamber includes five tube-like beams, or O-beams, which are longitudinally disposed in the upper chamber. The O-beams are heat welded to the top and bottom portion of the upper chamber in a series of spaced, elipse-like, welds along each O-beam. This provides the upper chamber with a softer body for user comfort. The upper chamber further includes a vertical wall, or I-beam, between the outer-most O-beam and the side edges of the chamber. The O-beams and I-beams of the upper chamber are also made of 16 gauge thickness polyvinyl chloride material. The beams are positioned in the upper chamber to allow air to work around their ends to fully inflate the chamber.

The upper chamber and the lower chamber have a common wall, that is the bottom portion of the upper chamber and the top portion of the lower chamber are the same wall (as shown in FIGS. 2, 3, and 10).

Although particular embodiments of the invention have been described in detail for purposes of illustration, various modifications may be made without departing from the spirit and scope of the invention. For example, the upper and/or the lower inflatable chamber can be provided in a wide variety of sizes and shapes. A stretchable fabric overlay, or any other fabric overlay, can be placed over, and potentially adhered to, the upper chamber, or over both chambers in place of a flocking material. A wide variety of designs can be printed on the outer body of the upper and/or lower chamber. Moreover, the upper and lower chamber may have one valve each; and/or each chamber may be divided into several inflatable chambers. Accordingly, the invention is not to be limited except as by the appended claims.

What is claimed is:

1. An inflatable air bed, comprising:

an inflatable lower chamber having an outer periphery, at least one valve for inflating and deflating the entire lower chamber, and longitudinally extending retention members to limit outward expansion of said lower chamber upon gas inflation; and an inflatable upper chamber, having an outer periphery, at least one valve for inflating and deflating the entire upper chamber, and longitudinally extending tubular O-beam retention members to limit outward expansion of said upper chamber, a non-inflatable middle chamber having a central gusset band welded to the outer periphery of said lower and upper chambers.

2. The air bed of claim 1, wherein said lower and upper chambers are constructed of a soft, flexible, resilient material.

3. The air bed of claim 2, wherein said resilient material is polyvinyl chloride.

4. The air bed of claim 1, wherein said lower and upper chambers are constructed of a material having a thickness of between about 12 and about 28 gauge.

5. The air bed of claim 4, wherein said lower chamber is constructed of a material having a thickness of between about 12 and about 20 gauge.

6. The air bed of claim 4, wherein said upper chamber is constructed of a material having a thickness of between about 16 and about 28 gauge.

7. The air bed of claim 1, wherein said upper chamber further includes a flocking material outer covering.

8. The air bed of claim 1, wherein said upper chamber further includes a top and a bottom layer, and said longitudinally extending tubular O-beam retention members are welded to said top and bottom layers in said upper chamber in a series of spaced welds.

9. An inflatable air bed, comprising:

an inflatable lower chamber having a top layer, a bottom layer, and a side gusset panel extending around and attached to the outer edges of the lower chamber top and bottom layer;

an inflatable upper chamber supported by the lower chamber and having a top layer, a bottom layer, and a side gusset panel extending around and attached to the outer edges of the upper chamber top and bottom layer;

the inflatable lower and upper chambers each having longitudinally extending retention structures joined to the top and bottom layers of each chamber to limit outward expansion, and at least one valve for inflating and deflating the entire chamber, and a non-inflatable middle chamber having a central gusset band welded to the outer edges of the upper and lower chambers to attach the upper chamber to the lower chamber.

10. The air bed of claim 9, wherein said top layer, bottom layer, and side gusset panel of said lower and upper chambers are constructed of a soft, flexible, resilient material.

11. The air bed of claim 10, wherein said material is polyvinyl chloride.

12. The air bed of claim 9, wherein said top layer, bottom layer, and side gusset panel of said lower and upper chambers are constructed of a material having a thickness of between about 12 and about 28 gauge.

13. The air bed of claim 12, wherein said top layer, bottom layer, and side gusset panel of said lower chamber is constructed of a material having a thickness of between about 12 and about 20 gauge.

14. The air bed of claim 12, wherein said top layer, bottom layer, and side gusset panel of said upper chamber is constructed of a material having a thickness of between about 16 and about 28 gauge.

15. The air bed of claim 9, wherein said central gusset band, and said lower and upper chamber side gusset panels are formed from a single side gusset portion extending around and attached to the outer edges of the lower and upper chamber top and bottom layers.

16. The air bed of claim 9, wherein said longitudinally extending retention structures in said upper chamber include tubular O-beams, which are welded to the top and bottom layers in said chamber in a series of spaced welds.

17. The air bed of claim 9, wherein said top layer of said inflatable upper chamber is covered with a flocking material.

18. The air bed of claim 11, wherein said flocking material is made of rayon fiber.

19. The air bed of claim 9, wherein said longitudinally extending retention members of said upper chamber comprise a plurality of coil beam structures.

20. The air bed of claim 19, wherein said longitudinally extending coil beam structures are welded to said top and bottom layers in said upper chamber in a series of spaced welds.

* * * * *